US006830023B2

(12) United States Patent
Tharman et al.

(10) Patent No.: US 6,830,023 B2
(45) Date of Patent: Dec. 14, 2004

(54) ELECTROMAGNETIC CHOKE SYSTEM FOR AN INTERNAL COMBUSTION ENGINE

(75) Inventors: Paul A. Tharman, Pewaukee, WI (US); Curtis L. Schultz, Grafton, WI (US); Jeffrey C. Blonski, Racine, WI (US); Thomas G. Guntly, Hartford, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 25 days.

(21) Appl. No.: 10/289,623

(22) Filed: Nov. 7, 2002

(65) Prior Publication Data

US 2004/0089259 A1 May 13, 2004

(51) Int. Cl.[7] ..... F02M 1/10
(52) U.S. Cl. ..... 123/179.18
(58) Field of Search ..... 123/179.18, 179.26

(56) References Cited

U.S. PATENT DOCUMENTS

| | | | | |
|---|---|---|---|---|
| 1,515,830 A | | 11/1924 | Burchett | |
| 1,528,484 A | | 3/1925 | Holley | |
| 1,534,742 A | | 4/1925 | Short et al. | |
| 1,577,765 A | | 3/1926 | Sisson | |
| 1,577,766 A | | 3/1926 | Sisson | |
| 1,907,351 A | | 5/1933 | King et al. | |
| 1,994,807 A | | 3/1935 | Blake et al. | |
| 1,995,145 A | | 3/1935 | Frost | |
| 2,969,785 A | | 1/1961 | Fuchs et al. | |
| 3,227,428 A | | 1/1966 | Charron | |
| 3,534,720 A | | 10/1970 | DuBois | |
| 3,608,533 A | | 9/1971 | Mennesson | |
| 3,744,468 A | | 7/1973 | Braun | |
| 3,955,550 A | * | 5/1976 | Carlsson | 123/149 D |
| 3,960,130 A | | 6/1976 | Peterson, Jr. | |
| 4,084,559 A | | 4/1978 | Wallbaum | |
| 4,193,384 A | | 3/1980 | Steiner et al. | |
| 4,358,727 A | * | 11/1982 | Campen | 322/90 |
| 4,474,009 A | | 10/1984 | Fried et al. | |
| 4,475,502 A | | 10/1984 | Matsumoto | |
| 4,768,478 A | | 9/1988 | Martel | |
| 5,158,051 A | | 10/1992 | Wada et al. | |
| 5,511,519 A | | 4/1996 | Watson et al. | |
| 5,537,964 A | | 7/1996 | Hoshiba | |
| 5,611,312 A | | 3/1997 | Swanson et al. | |
| 5,660,765 A | | 8/1997 | King et al. | |
| 5,832,888 A | | 11/1998 | Griffiths et al. | |
| 6,242,828 B1 | | 6/2001 | Rose | |
| 6,752,110 B2 | * | 6/2004 | Tharman et al. | 123/179.18 |

FOREIGN PATENT DOCUMENTS

| | | |
|---|---|---|
| GB | 1082603 | 9/1967 |
| JP | 111182348 | 7/1999 |

* cited by examiner

*Primary Examiner*—Henry C. Yuen
*Assistant Examiner*—Arnold Castro
(74) *Attorney, Agent, or Firm*—Michael Best & Friedrich, LLP

(57) ABSTRACT

An engine starting system that includes a power source, an electromagnetic coil and core, and a choke valve disposed in an air intake of an air/fuel-mixing device of an internal combustion engine. At the time of starting the engine, the power source outputs an electrical signal to an electromagnetic coil and core, inducing a magnetic field from the electromagnetic coil and the core. The magnetic field from the core moves the choke valve toward a substantially closed position that enriches an intake mixture of fuel and air to the engine during starting. In one embodiment, the power source includes a moving magnet that interacts with a stator coil to provide the electrical signal to the electromagnetic coil. In another embodiment, the closing of a starter switch allows a battery to provide the electrical power to the electromagnetic coil.

12 Claims, 4 Drawing Sheets

ELECTROMAGNETIC CHOKE SYSTEM FOR AN INTERNAL COMBUSTION ENGINE

BACKGROUND OF THE INVENTION

The present invention relates to an engine starting system for an internal combustion engine. In particular, the present invention relates to electromagnetically-actuated choke system for a small engine.

Internal combustion engines often include a choke system or assembly to regulate the air/fuel mixture to the engine during starting. A choke valve typically regulates the air flow to the engine during starting. A typical choke assembly includes a mechanical actuator to regulate the choke valve position. When initially starting an engine, the choke valve reduces the air flow to the engine to enrich the air/fuel mixture. During normal engine operation, the choke valve is not needed because the engine no longer requires a rich air/fuel mixture.

SUMMARY OF THE INVENTION

One embodiment of the invention provides an engine starting system for an internal combustion engine that includes a power source, an electromagnetic coil and core, and a choke valve disposed in an air intake of an air/fuel-mixing device of an engine. The power source provides an electrical signal to the electromagnetic coil. One embodiment of the power source includes at least one magnet positioned on a moving component during starting of the engine, and a stator coil positioned on a stationary part near the at least one magnet. At the time of starting the engine, the at least one magnet moves past the stator coil in such a way as to induce an electrical signal in the stator coil. The stator coil outputs the electrical signal to an electromagnetic coil and core. The electrical signal induces a magnetic field from the electromagnetic coil through the core. The magnetic field through the core moves the choke valve toward a closed position that enriches an intake mixture of fuel and air to an engine. In one embodiment, the magnetic field moves an arm interconnected with the choke valve. Upon interruption of the electrical signal from the stator coil, the magnetic field is interrupted and a spring returns the choke valve towards its original open position.

As noted above, the electrical signal to the electrical magnetic coil is induced by at least one magnet and its respective magnetic field moving past a stator coil. In one embodiment of the engine starting system, the at least one magnet is positioned on a flywheel and the stator coil positioned on a stationary component underneath the flywheel. For example, an ignition coil can be used as the stator coil. In an alternative embodiment, the stator coil can be separate from the ignition coil. In another embodiment, the at least one magnet is positioned on a pull rope, and the stator coil is positioned on a stationary component of the engine. In yet another embodiment, the at least one magnet is positioned on a rewind pulley, and the stator coil is positioned on a stationary component of the engine in the vicinity of the magnet. In yet another embodiment, the magnet and stator coil are located in a generator mechanically connected to the rewind pulley and pulley rope. The operator's pull of the pulley rope moves the rewind pulley and interconnected generator to provide an electrical signal to the electromagnetic coil.

In yet another embodiment of the invention, the power source includes a battery, and the engine starting system includes a starter motor and a starter switch. The starter switch is electrically connected between the battery and the starter motor. The electromagnetic coil is electrically connected to the starter switch. When the starter switch is closed at starting, the battery supplies electrical power to the starter-motor and to the electromagnetic coil. The electrical power to the electromagnetic coil generates a magnetic field through the core. The magnetic field through the core causes the choke valve to move to a substantially closed position that enriches an intake mixture of fuel and air to the engine. When the starter switch interrupts electrical power to the starter motor and to the electromagnetic coil, a spring biases the choke valve to return to its original open position.

If either the non-ignition stator coil, battery, or electromagnetic coil fails during engine operation, the engine can continue to operate since the choke valve is biased to the open position. Also, the engine can still be started by manually holding the choke arm to a closed position.

Another embodiment of the invention further includes a temperature switch electrically connected between the negative terminal of the electromagnetic coil and electrical ground. Above a certain threshold temperature, the temperature switch interrupts the power supplied to the electromagnetic coil so that the choke valve remains in a substantially open position.

Another embodiment of the invention further includes a free-wheeling diode electrically connected between the terminals of the electromagnetic coil. After electrical power is interrupted to the electromagnetic coil, the free wheeling diode recirculates and dissipates the electrical current in the electromagnetic coil to enhance the response of the choke valve to an interruption of the electrical signal to the electromagnetic coil.

In a small engine application, the invention regulates the air intake of an air/fuel-mixing device based on electromagnetic actuation of the choke valve. Electrically connecting a temperature switch and free-wheeling diode provides an economical means for starting the engine at hot (versus cold) temperatures by keeping the choke valve open.

As is apparent from the above, it is an aspect of the invention to provide an exemplary engine starting system that regulates the intake of air to the air/fuel mixing device of an engine based upon electromagnetic actuation of the choke valve position. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
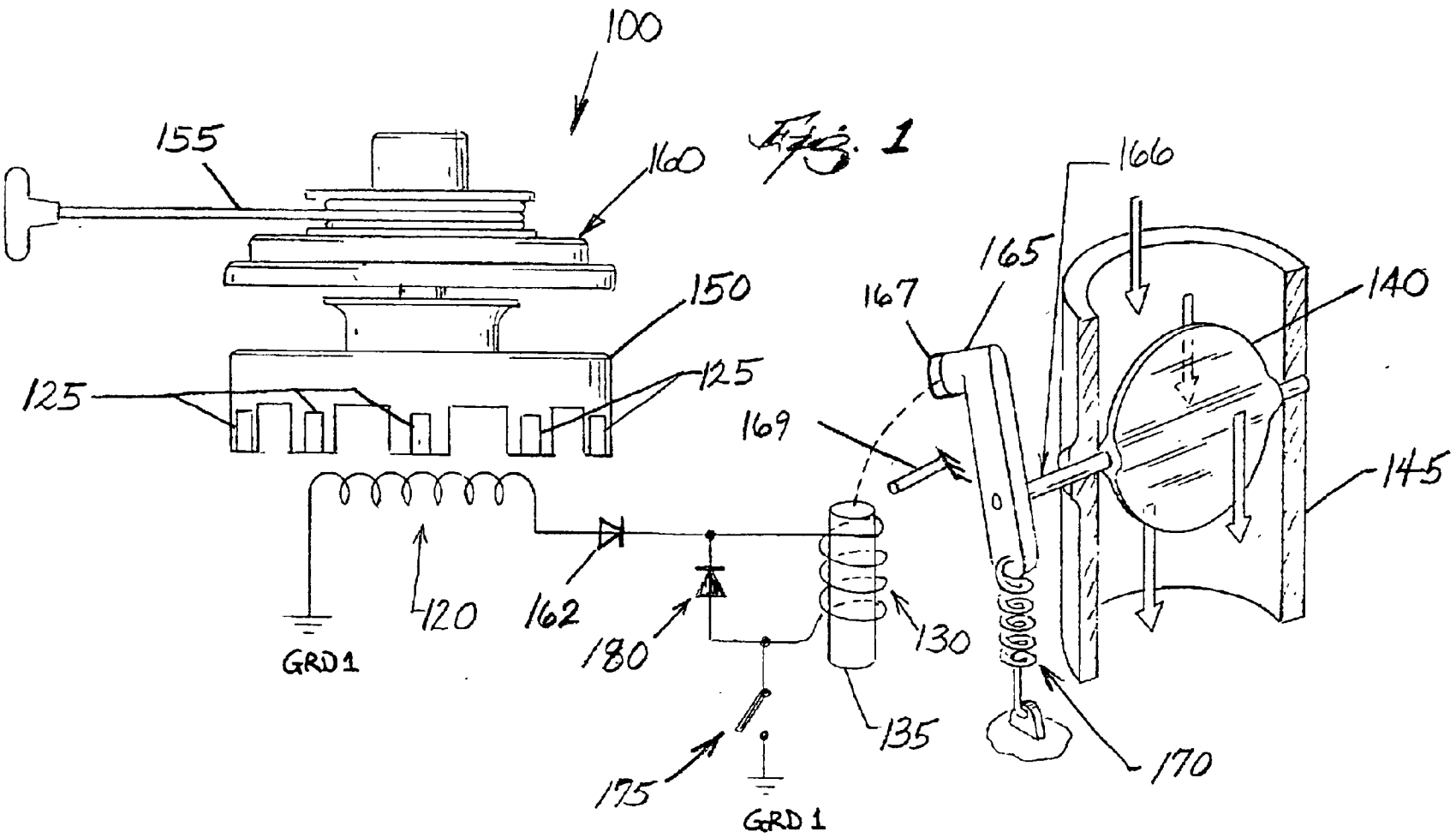
FIG. 1 is a schematic diagram of an engine starting system embodying the invention that includes magnets positioned on the flywheel.

Referring to FIG. 1, one embodiment of the invention is an engine starting system 100 that includes a stator coil 120, at least one magnet 125, an electromagnetic coil 130, a core 135, and a choke valve 140 disposed in air intake 145 of an air/fuel mixing device of an engine (not shown).

In the embodiment shown in FIG. 1, the system 100 utilizes electromagnetic induction to provide a power source that creates a voltage or electrical signal that initiates movement of the choke valve 140 toward a closed position at the time of starting the engine. As shown in FIG. 1, one way of creating an electrical signal through electromagnetic induction is by providing a changing magnetic field through a stator coil 120. The direction of the changing magnetic field dictates the direction of the electrical signal. The system 100 provides a changing magnetic field by positioning at least one magnet 125 on a moving part of the engine at the time of starting the engine. The stator coil 120 is positioned on a stationary part near the moving magnets 125. At the time of starting the engine, the moving magnets 125 provides a changing magnetic field that induces a voltage or electrical signal from the stator coil 120. The position of the stator coil 120 can vary depending on the relevant placement of the magnets 125 on the moving part. The stator coil 120 can be positioned on the stationary part using any suitable means known to those in the art (e.g., adhesives, mounted on a circuit board, mounted in a housing, etc.). The location of the stationary part does not limit the scope of the invention. The number of turns and gauge of the stator coil 120 and the number and size of the magnets 125 can vary depending on the distance from the stator coil 120, the speed of the moving part, and the desired magnitude of electrical signal to the electromagnetic coil 130. FIGS. 1–4 show the stator coil 120 for schematic illustration purposes only and are not limiting on the orientation of the stator coil 120 in relation to the moving magnets 125. The orientation of the stator coil 120 can vary with respect to the orientation of the magnetic field and the direction of the moving magnets 125. In another embodiment, the orientation of the stator coil 120 can also include a core to enhance the inducement of a voltage or electrical signal from the coil 120. In yet another embodiment, multiple stator coils 120 can be electrically connected in series and/or parallel to provide the electrical power to the electromagnetic coil 130. In further addition, the type of magnet (e.g., ceramic, flexible, rare earth magnets), and shape (e.g., ring, horseshoe, rods, bars, buttons, etc.) does not limit the scope of the invention.

In one embodiment and illustrated in FIG. 1, at least one magnet 125 is positioned on a rotating flywheel 150, and the stator coil 120 is positioned on a stationary part (not shown) underneath the flywheel 150. At the time starting, an operator's pull of the pull rope 155 rotates the pulley 160 and flywheel 150. The rotating flywheel 150 and attached magnets 125 provide the changing magnetic field that induces an electrical signal in the stator coil 120. The magnets 125 can be positioned on the flywheel 155 using any suitable means known in the art (e.g., adhesives, spot-welded, etc.).

In one embodiment, the stator coil 120 is the magneto coil of an engine without a battery. At least one magnet 125 is positioned on the flywheel 150 as described above. The magneto coil is positioned near the flywheel 150 such that the magnets 125 move past the magneto coil. The moving flywheel 150 and magnets 125 provide a changing magnetic field that induces a potential difference or voltage across the magneto coil. In a typical application, the voltage across the magneto coil generates the spark at the spark plug to fire the engine. In this embodiment, the induced voltage across the magneto coil also provides the electrical power to the electromagnetic coil 130.

In yet another embodiment, the stator coil 120 is the ignition coil of an engine having a battery. Similar to the magneto coil described above, at least one magnet 125 on a moving flywheel 150 induces a potential difference or voltage across the ignition coil. In a typical application, the induced voltage signal from the ignition coil generates the spark at the spark plug(s) to fire the engine. Similar to the embodiment discussed above, the voltage signal across the ignition coil also provides the electrical power to the electromagnetic coil 130.

For the above described embodiments where the stator coil 120 is a magneto coil or ignition coil, the electrical power to the electromagnetic coil 130 is interrupted upon normal operation of the engine. In one embodiment, a timing device interrupts electrical power to the electromagnetic coil 130 after a desired time interval. In another embodiment, a speed sensor (e.g., revolutions per minute) electrically connected to a relay switch can interrupt electrical power to the electromagnetic coil upon detecting a threshold engine speed. Upon interruption of electrical power to the coil and the resultant interruption of the magnetic field through the core, the choke valve is biased toward an open position for normal operation of the engine.

As shown in FIG. 1 and described above, the electromagnetic coil 130 receives electrical power or a signal from the stator coil 120 at the time of starting the engine. The electromagnetic coil 130 has a first terminal electrically connected to the stator coil 120 and a second terminal electrically connected to electrical ground GRD1. The electrical signal received by the electromagnetic coil 130 induces a magnetic field through the core 135. The exemplary core 135 is ferromagnetic material (e.g., cold rolled steel, iron) which concentrates the magnetic lines of flux generated at the electromagnetic coil 130. In response to the magnetic field, the choke valve 140 moves toward a substantially closed position to enrich the air/fuel mixture to the engine. The number and gauge of windings of the electromagnetic coil 130 can vary depending on the necessary strength of the magnetic field to move the choke valve 140. Additionally, the shape (e.g., bar, rod, ring), size, and material (e.g., iron, steel)) composition of the core 135 does not limit the scope of the invention.

As noted above, the choke valve 140 shown in FIG. 1 is normally disposed in an air intake 145 of an air/fuel-mixing device. The choke valve 140 moves in response to the energized electromagnetic coil 130 and core 135 described above. The position of the choke valve 140 regulates the mixture of air and fuel to the engine at the time of starting the engine.

As shown in FIG. 1, the engine starter system 100 can further include a lever 165 connected to an arm 166, which in turn is connected to the choke valve 140. The electromagnetic coil 130 and core 135 are positioned near the arm 165 such that the magnetic field from the core 135 moves the lever 165, and arm 166 and thereby moves choke valve 140. The lever 165 can be connected to linearly or rotationally actuate the choke valve 140 in response to the magnetic field through the core 135. One embodiment of the lever 165 is comprised of a steel plate. However, the lever 165 can be comprised of any suitable material known to those skilled in the art. The lever 165 can further include a lever magnet 167 having a magnetic pole that is attracted by the magnetic field through the core 135. Similar to magnet 125, the lever magnet 167 can be any suitable size, shape (e.g., ring, bar, rod, button, horseshoe), and material (e.g., ceramic, flexible, rare earth metal) known to those in that art. Also, the system 100 can further include a stop 169 that limits the range of motion of the lever 165 as it moves toward the core 135. In an alternative embodiment, the magnetic pole of the lever magnet 167 can be aligned to repel the magnetic field generated by the core 135 to move the choke valve 140 to a substantially closed position.

Upon interruption of the electrical signal to the electromagnetic coil 130, a spring 170 returns the lever 165 and choke valve 140 toward its original closed position. In one embodiment, the spring 170 is connected to the lever 165. In another embodiment, the spring 170 is connected to the choke valve 140. Of course, the type and connection point of the spring 170 does not limit the scope of the invention.

Also shown in FIG. 1, the engine starter system 100 can further include a temperature switch 175 electrically connected between the second or negative terminal of the electromagnetic coil 130 and the electrical ground. Above a certain threshold temperature, the temperature switch 175 interrupts the electrical power supplied to the electromagnetic coil 130, allowing the choke valve 140 to return to a substantially open position. Thereby, the choke is made inoperable during hot restarts of the engine. As shown in FIG. 1, the negative terminal of the electromagnetic coil 130 is electrically connected to one terminal of the temperature switch 175. The other terminal of the temperature switch 175 is electrically connected to the electrical ground GRD1. The temperature switch 175 can be mounted in any suitable location on or near the engine (e.g., the exhaust port, the engine housing, etc.) to provide a measure of temperature. Additionally, the temperature switch 175 can be mounted using any suitable means (e.g., bolt, screw, spot-weld, adhesive, etc.) known to those in the art. An exemplary temperature switch 175 is an Elmwood sensor Part No. 3455RC. Other suitable types of temperature switches know to those in the art can be used as well.

In yet another embodiment as shown in FIG. 1, the system 100 can further include a free-wheeling diode 180 electrically connected between the positive and negative terminals of the electromagnetic coil 130. The free-wheeling diode 180 allows current to re-circulate and dissipate after the electrical power is interrupted to the electromagnetic coil 130. Thereby, the electromagnetic coil 130 and core 135 more readily responds to an interruption of the electrical signal upon normal operation of the engine. Any suitable free-wheeling diode 180 known in the art can be used.

Figure 2:
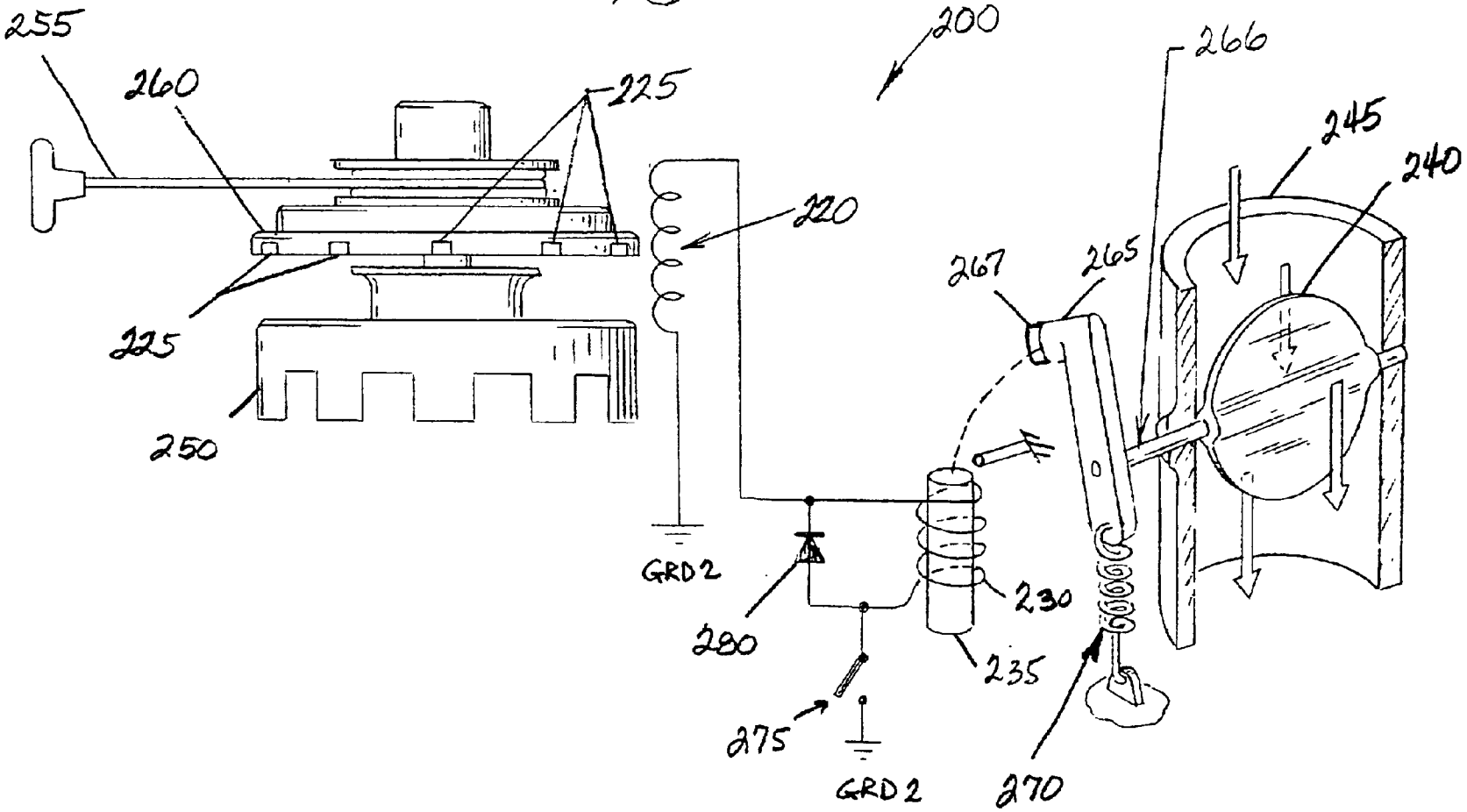
FIG. 2 is schematic diagram of an engine starting system embodying the invention that includes magnets positioned on a starter pulley.

Another embodiment of a moving magnet and a stator coil element combination is illustrated by way of example only in FIG. 2. Many of the elements of the embodiment illustrated in FIG. 2 are the same or similar to those used in the embodiment illustrated in FIG. 1 (described above) and operate in the same or similar manner. Elements in FIG. 2 that correspond to those in FIG. 1 are therefore assigned the same reference numbers increased by 100. Accordingly, with the exception of the differences noted below, the description of the various elements illustrated in FIG. 2 can be found in the description accompanying FIG. 1 above.

FIG. 2 depicts a starter system 200 that includes, among other things, at least one magnet 225 positioned on the starter pulley 260 of the engine. Again, the stator coil 220 is positioned on a stationary component of the engine. According to this embodiment, as an operator pulls the pull rope 225, the rope 225 rotates the pulley 260 and attached magnets 225. The moving magnets 225 provide a changing magnetic field that induces a voltage or electrical signal from the stator coil 220. The magnets 225 can be positioned on the pulley 260 using any suitable means (e.g., adhesives, spot welded, bolted, etc.) known to those in the art.

In another embodiment, the moving magnets 125 and stator coil 120 shown in the FIG. 2 can be located in a generator mechanically connected to the starter pulley 260. An operator's pull of the pull cord 225 moves the starter pulley 260 to move the magnets 125 past one or more stator coils 120 inside the generator to provide an output of electrical power to the electromagnetic coil 130.

Figure 3:
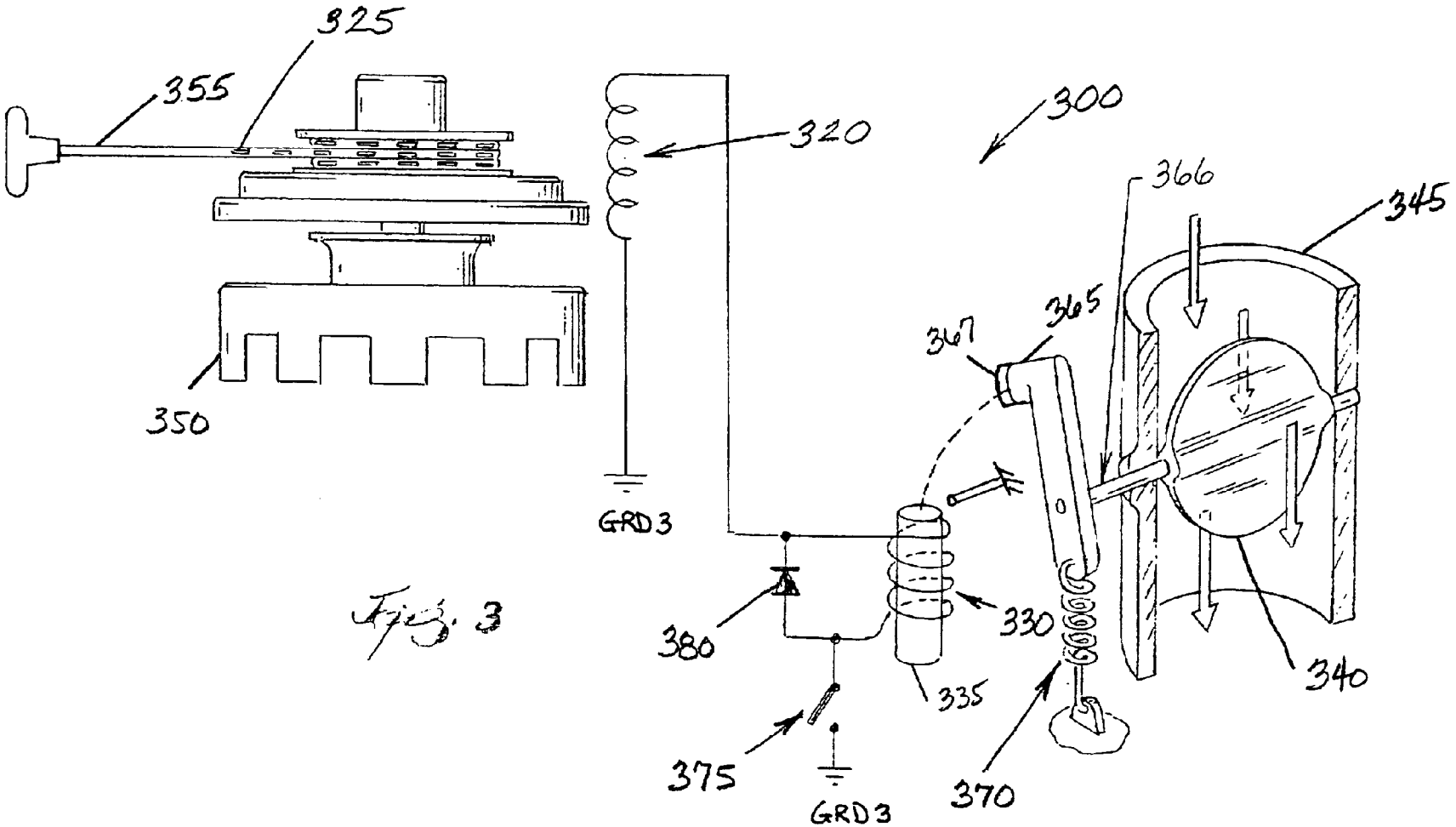
FIG. 3 is schematic diagram of an engine starting system embodying the invention that includes magnets positioned on a pulley rope.

Yet another embodiment of a moving magnet and stator coil element combination is illustrated by way of example only in FIG. 3. Many of the elements of the embodiment illustrated in FIG. 3 are the same or similar to those used in the embodiment illustrated in FIG. 1 (described above) and operate in the same or similar manner. Elements in FIG. 3 that correspond to those in FIG. 1 are therefore assigned the same reference numbers increased by 200. Accordingly, with the exception of the differences noted below, the description of the various elements illustrated in FIG. 3 can be found in the description accompanying FIG. 1 above.

FIG. 3 depicts a starter system 300 that includes, among other things, at least one magnet 325 positioned on the pull rope or cord 355 to start the engine. Again, the stator coil 320 is positioned on a stationary component of the engine. As the operator pulls the pull rope 355, the moving magnets 325 positioned on the rope 355 provide the changing magnetic field to induce an electrical signal output from the stator coil 355. In one embodiment, the stator coil is positioned such that the pull rope 355 passes through the stator coil 320. In an alternative embodiment, the stator coil 320 is positioned such that the pull rope 335 passes alongside the stator coil 320. The magnets 325 can be positioned on the rope 355 using suitable means known to those in the art (e.g., adhesives, structurally threaded to the rope, etc.).

Figure 4:
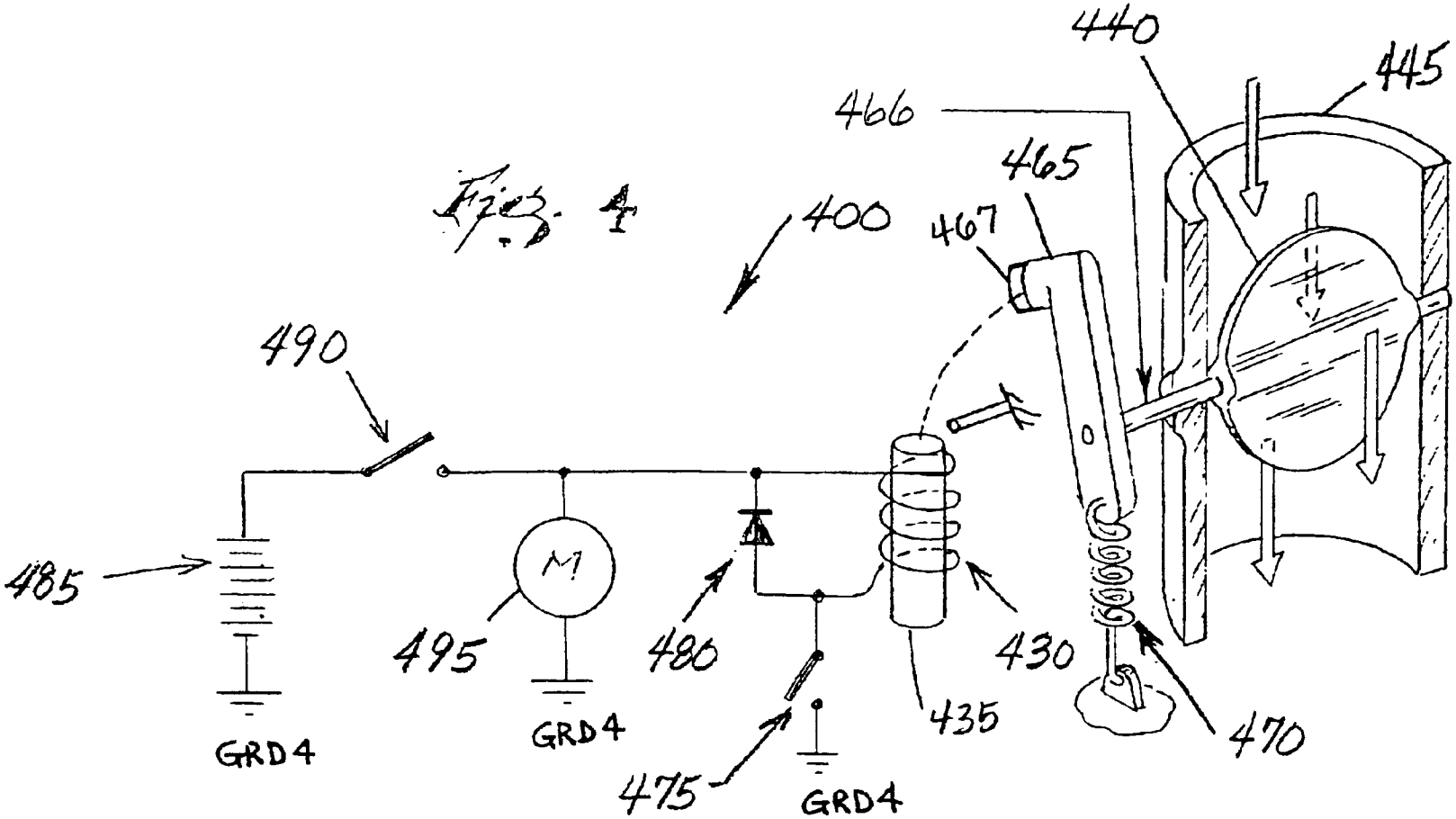
FIG. 4 is a schematic diagram of an engine starting system embodying the invention that includes a battery and a starter switch.

Another embodiment of a power source is illustrated by way of example in FIG. 4. Many of the elements of the embodiment illustrated in FIG. 4 are the same or similar to those used in the embodiment illustrated in FIG. 1 (described above) and operate in the same or similar manner. Elements in FIG. 4 that correspond to those in FIG. 1 are therefore assigned the same reference numbers increased by 300. Accordingly, with the exception of the differences noted below, the description of the various elements illustrated in FIG. 4 can be found in the description accompanying FIG. 1 above.

Unlike the embodiments shown in FIGS. 1–3, FIG. 4 depicts a system 400 that includes, among other things, a battery 485 as the power source in place of the moving magnet and stator coil element combination. The battery 485 is electrically connected to the first or positive terminal of the starter switch 490. The negative terminal of the starter switch 490 is electrically connected to the positive terminal of the starter motor 495. The positive terminal of the starter motor 495 is also electrically connected to the first or positive terminal of the electromagnet coil 430. The second or negative terminals of the starter motor 495 and electrical coil 130 are electrically connected to the electrical ground GRD4. When an operator activates the starter switch 490, the starter switch 490 closes, enabling the battery 485 to provide power to the starter motor 495 and to the electromagnetic coil 430. Upon receiving power, the starter motor 495 cranks the engine to start. When the operator disengages the starter, the starter switch 490 opens and interrupts the electrical power to the starter motor 495 and electromagnetic coil 430. An exemplary battery 485 is a 12-volt DC battery suitable to energize the starter motor 495. Of course, the type of starter switch 490 and starter motor 495 does not limit the scope of the invention.

In typical operation of the embodiments of the invention as shown in FIGS. 1–3, the operator pulls the pull cord 155, 255, 355 to start the engine. At least one magnet 125, 225, 325 is positioned on and moves with a moving part at the time of starting the engine. The moving magnet 125, 225, 325 provides a changing magnetic field. The stator coil 120, 220, 320 is positioned near the at least one magnet 125, 225, 325 such that the changing magnetic field induces an electrical signal in the stator coil 120, 220, 320. The stator coil 120, 220, 320 provides the electrical signal to the electromagnetic coil 130, 230, 330. In an alternative embodiment as shown in FIG. 4, the operator can turn the ignition key or press the starter button to close the starter switch 490, thereby providing electrical power from the battery 485 to the electromagnetic coil 430. The electromagnetic coil 130, 230, 330, 430 is electrically connected to the same electrical ground GRD1, GRD2, GRD3, GRD4 as the power source so as to complete the path of electrical charge carriers in the circuit.

The electromagnetic coil 130, 230, 330, 430 receives the electrical signal from the stator coil 120, 220, 320 or battery 485, to induce a magnetic field from the core 135, 235, 335, 435. The magnetic field moves the lever 165, 265, 365, 465 connected to the choke valve 140, 240, 340, 440 toward a substantially closed position. Upon normal operation of the engine, the electrical signal to the electromagnetic coil 130, 230, 330, 430 is interrupted either because the magnet 125, 225, 325 ceases to create a changing magnetic field or the starter switch 490 interrupts the electrical power from the battery 485. The lack of an electrical signal to the electromagnetic coil 130, 230, 330, 430 interrupts the magnetic field from the core 135, 235, 335, 435. The loss of the magnetic field allows the spring 170, 270, 370,470 to return the lever 165, 265, 365, 465 and connected choke valve 140, 240, 340, 440 toward a substantially open position.

Thus, the invention provides, among other things, an exemplary engine starting system that includes an electromagnetic choke valve assembly. Various features and advantages of the invention are set forth in the following claims.

What is claimed is:

1. An engine starting system, comprising:

a power source having a first terminal electrically connected to an electrical ground, and having a second terminal;

a single electromagnetic coil having a first terminal electrically connected to the electrical ground, and having a second terminal electrically connected to the second terminal of the power source to receive an electrical signal from the power source;

a core having a magnetic field induced from the electromagnetic coil;

a choke valve, disposed in an air intake of an air/fuel-mixing device, that moves to a closed position in response to the magnetic field produced by the single electromagnetic coil;

a biasing device that biases the choke valve to move to a substantially open position when the magnetic field is interrupted; and a free wheeling diode electrically connected to the first terminal and the second terminal of the single electromagnetic coil.

2. The engine starting system as claimed in claim 1, further comprising: a temperature switch electrically connected between the electromagnetic coil and the electrical ground, wherein the temperature switch interrupts the electrical signal supplied to the electromagnetic coil above a threshold temperature value.

3. The engine starting system as claimed in claim 1, further comprising:

a lever connected to the choke valve, wherein the magnetic field from the core moves the lever and choke valve to a substantially closed position.

4. The engine starting system as claimed in claim 3, wherein the biasing device is a spring connected to the lever.

5. The engine starting system as claimed in claim 1, wherein the power source includes a stator coil and at least one moveable magnet that magnetically interacts with the stator coil.

6. The engine starting system as claimed in claim 5, wherein the stator coil is an ignition coil of the engine.

7. The engine starting system as claimed in claim 5, wherein the stator coil is energized by a flywheel magnet.

8. The engine starting system as claimed in claim 5, wherein the at least one magnet is positioned on a flywheel, and the stator coil is positioned on a stationary component of the engine underneath the flywheel.

9. The engine starting system as claimed in claim 5, wherein the at least one magnet is positioned on a pull rope, and the stator coil is positioned on a stationary component of the engine.

10. The engine starting system as claimed in claim 5, wherein the at least one magnet is positioned on a rewind pulley, and the stator coil is positioned on a stationary component of the engine.

11. The engine starting system as claimed in claim 5, wherein the at least one magnet and the stator coil are located in a generator mechanically connected to a rewind pulley and pulley rope, and wherein an operator's pull of the pulley rope moves the rewind pulley and connected generator to provide the electrical signal to the electromagnetic coil.

12. The starting system as claimed in claim 1, wherein the power source includes:

a battery;

a starter motor that is energized by the battery; and a starter switch connected between the battery and the starter motor.

* * * * *